US012044456B2

(12) United States Patent
Miao et al.

(10) Patent No.: US 12,044,456 B2
(45) **Date of Patent: *Jul. 23, 2024**

(54) REFRIGERATOR HAVING AIR BLOWER LOCATED DOWNSTREAM OF TRANSVERSE SIDE OF EVAPORATOR

(71) Applicant: HAIER SMART HOME CO., LTD., Shandong (CN)

(72) Inventors: Jianlin Miao, Qingdao (CN); Wei Li, Qingdao (CN); Chunyang Li, Qingdao (CN); Ming Wang, Qingdao (CN)

(73) Assignee: HAIER SMART HOME CO., LTD., Qingdao (CN)

( * ) Notice: Subject to any disclaimer, the term of this patent is extended or adjusted under 35 U.S.C. 154(b) by 397 days.

This patent is subject to a terminal disclaimer.

(21) Appl. No.: 17/434,342

(22) PCT Filed: Feb. 19, 2020

(86) PCT No.: PCT/CN2020/075882

§ 371 (c)(1),
(2) Date: Aug. 26, 2021

(87) PCT Pub. No.: WO2020/173355

PCT Pub. Date: Sep. 3, 2020

(65) Prior Publication Data

US 2022/0146179 A1 May 12, 2022

(30) Foreign Application Priority Data

Feb. 26, 2019 (CN) ..... 201910142755.8

(51) Int. Cl.
*F25D 11/02* (2006.01)
*F25D 17/06* (2006.01)
(Continued)

(52) U.S. Cl.
CPC ..... *F25D 11/02* (2013.01); *F25D 17/065* (2013.01); *F25D 17/067* (2013.01); *F25D 17/08* (2013.01);
(Continued)

(58) Field of Classification Search
CPC ..... F25D 11/02; F25D 17/065; F25D 17/067; F25D 17/08; F25D 23/006; F25D 2317/063; F25D 2500/02
See application file for complete search history.

(56) References Cited

U.S. PATENT DOCUMENTS 2,068,435 A 1/1937 Rutishauser
2,669,850 A 2/1954 Bishop
(Continued)

FOREIGN PATENT DOCUMENTS

CN 2550700 Y 5/2003
CN 201706812 U 1/2011
(Continued)

OTHER PUBLICATIONS

WO-3055554-A1 English Translation (Year: 2000).*
(Continued)

*Primary Examiner* — Marc E Norman
(74) *Attorney, Agent, or Firm* — Alston & Bird LLP

(57) ABSTRACT

A refrigerator (100) having an air blower (102) located downstream of a transverse side of an evaporator (150) is provided. The refrigerator includes: a cabinet defining a cooling chamber (133) and at least one storage compartment, the evaporator (150) arranged in the cooling chamber (133), and the air blower (102) arranged on the transverse side of the evaporator (150) and located downstream of the evaporator (150) in an airflow path. The air blower (102) does not occupy a space behind or in front of the evaporator (150), which reduces a space occupied by the cooling
(Continued)

chamber (133) in a front-rear direction, and ensures the thickness of a foamed material between the rear of the cooling chamber (133) and a housing of the cabinet.

8 Claims, 6 Drawing Sheets

(51) Int. Cl.
*F25D 17/08* (2006.01)
*F25D 23/00* (2006.01)

(52) U.S. Cl.
CPC ..... *F25D 23/006* (2013.01); *F25D 2317/063* (2013.01); *F25D 2500/02* (2013.01)

(56) References Cited

U.S. PATENT DOCUMENTS

| | | | | |
|---|---|---|---|---|
| 2,767,558 | A | 10/1956 | Wallenbrock et al. | |
| 3,050,956 | A | 8/1962 | Mann et al. | |
| 3,287,930 | A | 11/1966 | O'Connell et al. | |
| 3,299,664 | A | 1/1967 | Booth | |
| 5,715,703 | A * | 2/1998 | Kopf | F25D 17/065 62/186 |
| 2004/0134221 | A1 | 7/2004 | Fee et al. | |
| 2007/0214823 | A1 | 9/2007 | Park | |

FOREIGN PATENT DOCUMENTS

| | | | | |
|---|---|---|---|---|
| CN | 210197826 | U | 3/2020 | |
| DE | 19933603 | A1 | 1/2001 | |
| FR | 2262913 | A1 | 11/1975 | |
| JP | H08285439 | A | 11/1996 | |
| JP | H10246554 | A | 9/1998 | |
| JP | 2000314580 | A | 11/2000 | |
| JP | 2003130531 | A | 5/2003 | |
| JP | 2009030864 | A | 2/2009 | |
| JP | 2012-042158 | A | 3/2012 | |
| JP | 2015001344 | A | 1/2015 | |
| KR | 1999-0057131 | A | 7/1999 | |
| KR | 20060078134 | A | 7/2006 | |
| WO | WO-0055554 | A1 * | 9/2000 | F25D 17/065 |

OTHER PUBLICATIONS

International Search Report for PCT/CN2020/075882 (ISA/CN) mailed May 14, 2020 with English translation (6 pages).
Written Opinion of the International Searching Authority for PCT/CN2020/075882 (ISA/CN) mailed May 14, 2020 with English translation (5 pages).
1st Office Action for Australia Application No. 2020229911 dated Jul. 18, 2022.
1st Office Action for EP Application No. 20763757.0 dated Apr. 4, 2022 (6 pages).
Supplementary European Search Report for EP Application No. 20763757.0 dated Mar. 21, 2022 (5 pages).
Notice of Acceptance for Australia Patent Application No. 2020229911 dated Nov. 22, 2022 (3 pages).
2nd Office Action for EP Patent Application No. 20763757.0 dated Sep. 5, 2022 (7 pages).
3rd Office Action for EP Application No. 20763757.0 dated Mar. 13, 2023 (6 pages).

* cited by examiner

REFRIGERATOR HAVING AIR BLOWER LOCATED DOWNSTREAM OF TRANSVERSE SIDE OF EVAPORATOR

TECHNICAL FIELD

The present invention relates to the technical field of household appliances, and in particular to a refrigerator having an air blower located downstream of a transverse side of an evaporator.

BACKGROUND ART

In an existing refrigerator, a fan for causing an airflow cooled by an evaporator to flow to a storage compartment is generally arranged downstream of the evaporator in a front-rear direction. The fan occupies a space in the front-rear direction of the refrigerator, so that a distance between the rear of an evaporator chamber and a housing of a cabinet is reduced, the thickness of a foamed material is reduced, and the refrigeration performance and the energy consumption of the refrigerator are adversely affected.

SUMMARY OF THE INVENTION

In view of the above problems, an object of the present invention is to provide a refrigerator that overcomes or at least partially solves the above problems.

A further object of the present invention is to improve the heat dissipation effect of a compressor chamber.

The present invention provides a refrigerator, including:

a cabinet, in which are defined a cooling chamber and at least one storage compartment;

an evaporator, arranged in the cooling chamber and configured to cool an airflow entering the cooling chamber to form a cooled airflow; and an air blower, located on a transverse side of the evaporator, located downstream of the evaporator in an airflow path, and configured to cause at least part of the cooled airflow to flow into the at least one storage compartment.

Optionally, the cabinet includes:

a freezing liner, in which the cooling chamber is defined at a lower part, the storage compartment including a freezing chamber defined by the freezing liner and located above the cooling chamber; and a freezing chamber air supply duct, located inside a first transverse side wall of the freezing liner and provided with at least one first air supply outlet communicated with the freezing chamber, the air blower being configured to cause at least part of the cooled airflow to flow into the freezing chamber through the freezing chamber air supply duct.

The air blower is arranged in the cooling chamber, located on a first transverse side of the evaporator, and configured to cause at least part of the cooled airflow to flow into the freezing chamber through the freezing chamber air supply duct.

Optionally, a freezing chamber return air inlet is formed on a second transverse side wall of the cooling chamber, so that a return airflow of the freezing chamber enters the cooling chamber through the freezing chamber return air inlet under the driving of the air blower and is cooled by the evaporator.

Optionally, the cabinet further includes:

a variable temperature liner, located above the freezing liner, the storage compartment including a variable temperature chamber defined by the variable temperature liner, and a variable temperature chamber return air inlet being formed in a region, corresponding to the evaporator, of a second transverse side wall of the freezing liner;

a variable temperature chamber air supply duct, arranged outside a first transverse side wall of the variable temperature liner, controllably communicated with the freezing chamber air supply duct through a variable temperature damper, and provided with at least one second air supply outlet communicated with the variable temperature chamber; and a variable temperature chamber return air duct, arranged outside a second transverse side wall of the variable temperature liner, and extending downwards to be communicated with the variable temperature chamber return air inlet, so that a return airflow of the variable temperature chamber enters the cooling chamber through the variable temperature chamber return air duct and the variable temperature chamber return air inlet under the driving of the air blower and is cooled by the evaporator.

Optionally, the evaporator is transversely arranged in the cooling chamber.

Optionally, a compressor chamber is further defined in the cabinet and is located behind and below the cooling chamber.

Optionally, the refrigerator further includes:

a compressor, a heat dissipation fan and a condenser which are transversely and sequentially arranged in the compressor chamber.

A bottom air inlet adjacent to the condenser and a bottom air outlet adjacent to the compressor, which are transversely arranged, are defined on a bottom wall of the cabinet.

The heat dissipation fan is further configured to suck ambient air from the bottom air inlet and cause the air to pass through the condenser and the compressor and then to flow into an ambient environment from the bottom air outlet.

Optionally, the cabinet further includes:

a bottom plate, including a bottom horizontal section located on a bottom front side and a bent section bending and extending upwards and rearwards from a rear end of the bottom horizontal section, the bent section including an inclined section located above the bottom air inlet and the bottom air outlet;

a supporting plate, located behind the bottom horizontal section, the bent section extending to an upper side of the supporting plate, wherein the supporting plate together with the bottom horizontal section forms the bottom wall of the cabinet and is spaced apart from the bottom horizontal section, so that a bottom opening is defined by the rear end of the bottom horizontal section and a front end of the supporting plate;

two side plates, extending upwards to both transverse sides of the bent section from both transverse sides of the supporting plate respectively to form two transverse side walls of the compressor chamber; and a vertically extending back plate, extending upwards from a rear end of the supporting plate to a rear end of the bent section to form a rear wall of the compressor chamber.

The compressor, the heat dissipation fan and the condenser are transversely and sequentially spaced apart on the supporting plate and are located in a space defined by the supporting plate, the two side plates, the back plate and the bent section.

The cabinet further includes a divider, which is arranged behind the bent section, has a front part connected to the rear end of the bottom horizontal section and a rear part connected to the front end of the supporting plate, and is configured to divide the bottom opening into the bottom air inlet and the bottom air outlet transversely arranged.

Optionally, the cabinet further includes:

a wind blocking strip extending forwards and rearwards, located between the bottom air inlet and the bottom air outlet, extending from a lower surface of the bottom horizontal section to a lower surface of the supporting plate, and connected to a lower end of the divider, so as to completely separate the bottom air inlet and the bottom air outlet using the wind blocking strip and the divider, so that when the refrigerator is placed on a supporting surface, a space between the bottom wall of the cabinet and the supporting surface is transversely divided to allow external air to enter the compressor chamber through the bottom air inlet on a transverse side of the wind blocking strip under the action of the heat dissipation fan, to sequentially flow through the condenser and the compressor, and to finally flow out of the bottom air outlet on the other transverse side of the wind blocking strip.

Optionally, a plate section of the back plate facing the condenser is a continuous plate surface.

In the refrigerator provided by the present invention, the air blower is located on the transverse side of the evaporator, and does not occupy a space behind or in front of the evaporator, which reduces a space occupied by the cooling chamber in a front-rear direction, and ensures the thickness of a foamed material between the rear of the cooling chamber and a housing of the cabinet. In addition, the air blower is located downstream of the evaporator in the airflow path, so that the flow of the cooled airflow to the storage compartment is accelerated, and the refrigerating speed can be increased.

Furthermore, in the refrigerator provided by the present invention, a lower space in the freezing liner defines the cooling chamber, the freezing chamber is located above the cooling chamber, the compressor chamber is located at the rear lower side of the cooling chamber, and the freezing chamber does not need to give way to the compressor chamber, so that the storage volume of the freezing chamber is increased, and the freezing chamber is a rectangular space convenient for placement of articles which are large in volume and are not easily divided. In addition, the air blower is arranged on the transverse side of the evaporator, so that the air blower is prevented from occupying the space behind or in front of the evaporator, the space occupied by the cooling chamber in the front-rear direction is reduced, the space between the rear lower side of the cooling chamber and the compressor chamber is increased, and the thickness of the foamed material between the rear lower side of the cooling chamber and the compressor chamber is increased, thereby ensuring the refrigeration performance of the refrigerator and reducing the energy consumption.

Furthermore, in the refrigerator provided by the present invention, the bottom of the cabinet is constructed into a three-dimensional structure by the bottom plate and the supporting plate of a special structure, an independent three-dimensional space is provided for the arrangement of the compressor, the supporting plate is used for supporting the compressor, and the influence of vibration of the compressor on other components at the bottom of the cabinet is reduced. In addition, a slope structure of the inclined section is capable of guiding and rectifying feeding airflow, so that the airflow entering from the bottom air inlet flows more concentratedly to the condenser, avoiding that the airflow is too dispersed to pass more through the condenser, thereby further ensuring the heat dissipation effect of the condenser. Moreover, the cabinet is designed into the above smart special structure, so that the bottom of the refrigerator is compact in structure and reasonable in layout, the overall volume of the refrigerator is reduced, the space at the bottom of the refrigerator is fully utilized, and the heat dissipation efficiency of the compressor and the condenser is ensured.

The above, as well as other objectives, advantages, and characteristics of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In figures.

DETAILED DESCRIPTION OF THE INVENTION

Figure 1:
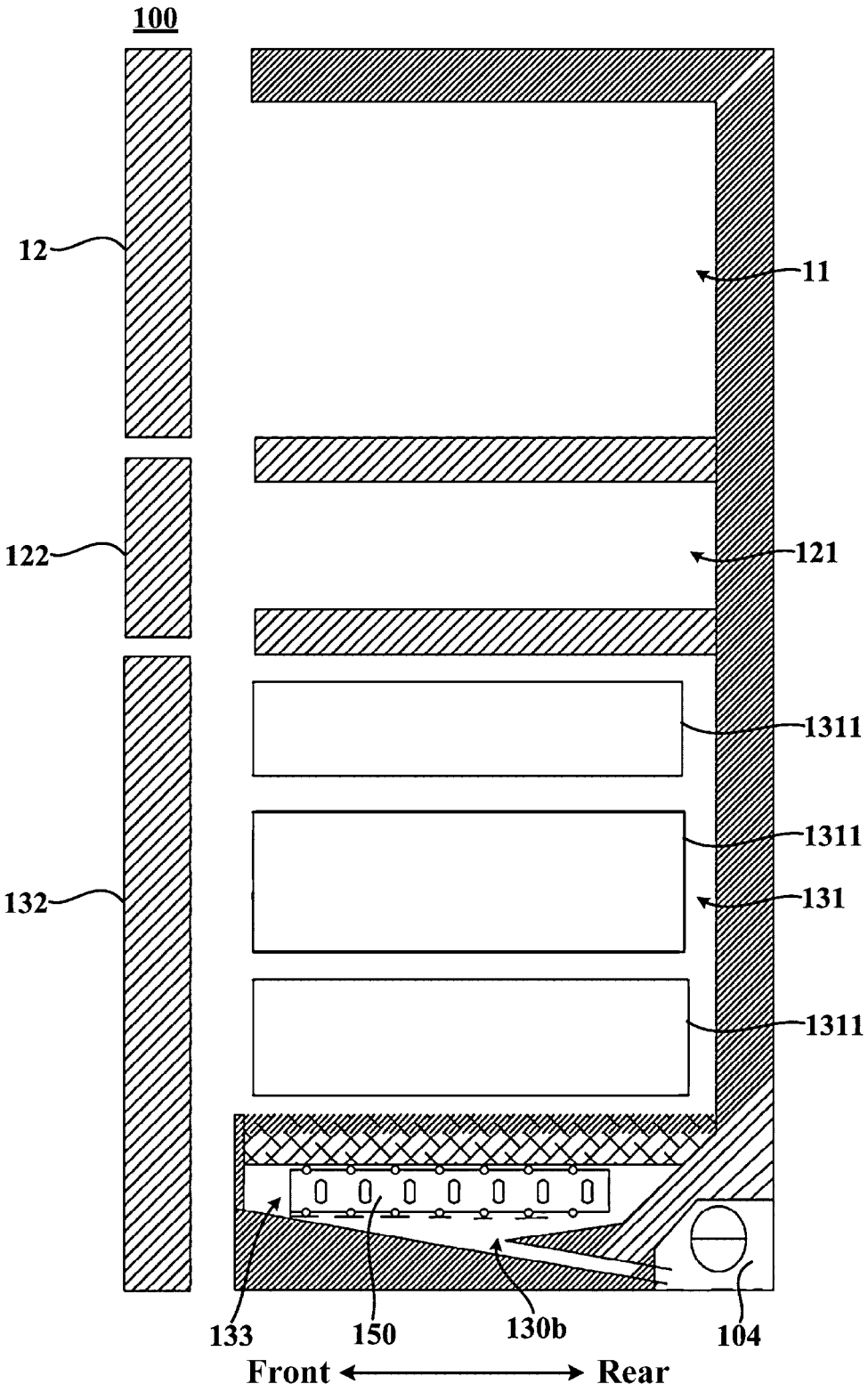
FIG. 1 is a schematic structure view of one direction of a refrigerator according to one embodiment of the present invention.
Figure 2:
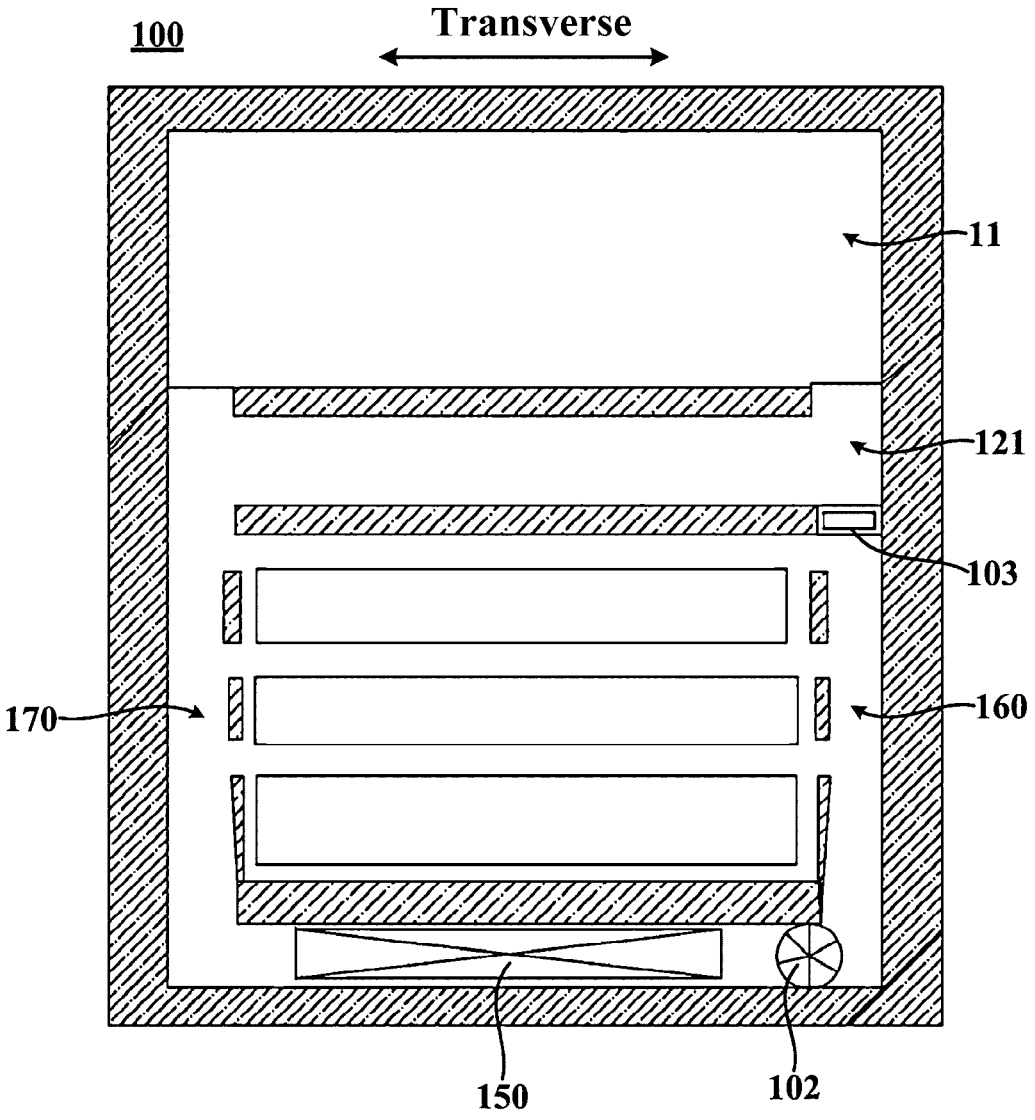
FIG. 2 is a schematic structure view of another direction of a refrigerator according to one embodiment of the present invention.
Figure 4:
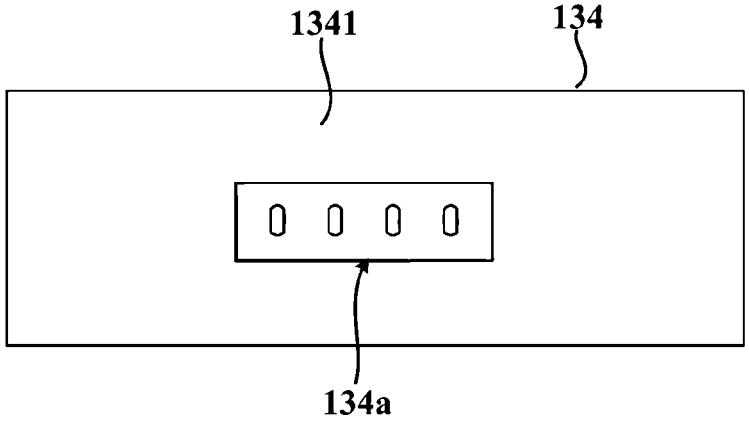
FIG. 4 is a schematic structure view of a casing of a refrigerator according to one embodiment of the present invention.
Figure 5:
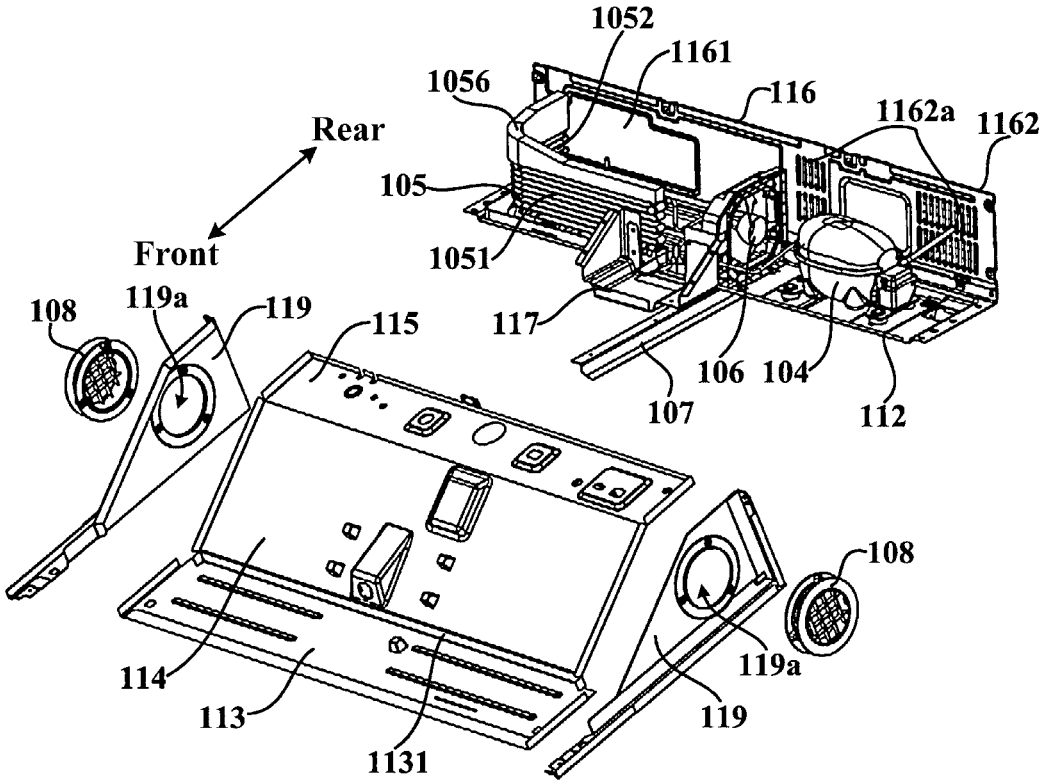
FIG. 5 is a partial exploded view of a refrigerator according to one embodiment of the present invention.
Figure 6:
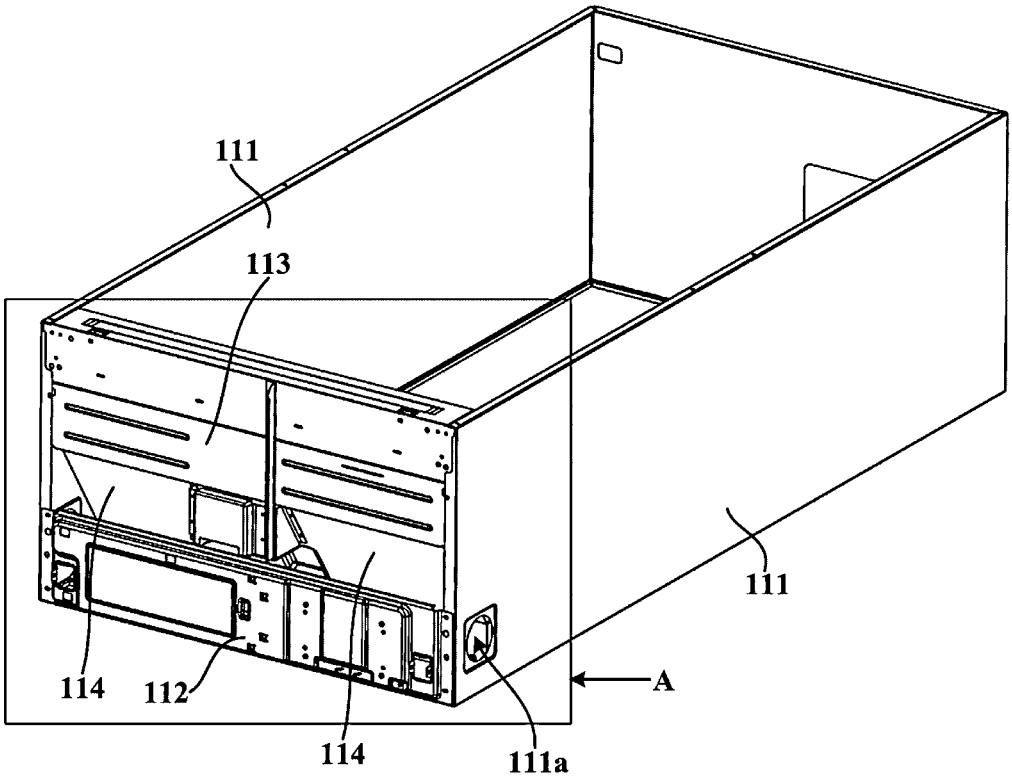
FIG. 6 is a schematic view of a housing of a refrigerator according to one embodiment of the present invention.
Figure 7:
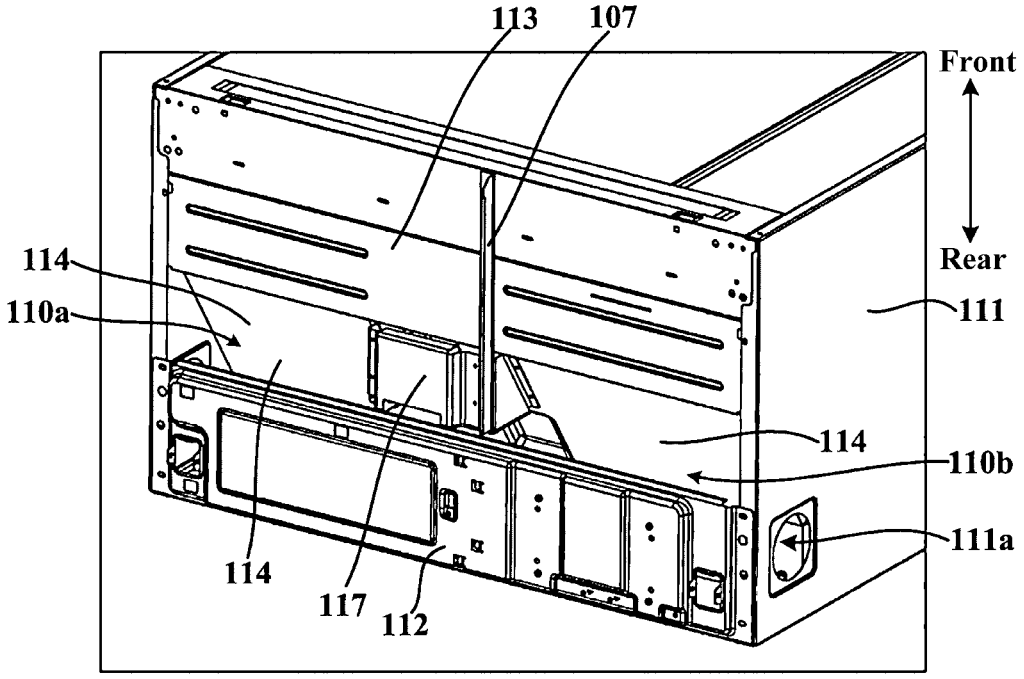
FIG. 7 is an enlarged view of a region A in FIG. 6.

The present embodiment first provides a refrigerator 100. The refrigerator 100 according to the embodiment of the present invention will be described with reference to FIGS. 1 to 7. In the following description, an orientation or position relationship indicated by "front", "rear", "upper", "lower" and the like is an orientation based on the refrigerator 100 as a reference, and "front" and "rear" are directions as indicated in FIGS. 1, 5 and 7. As shown in FIG. 2, "transverse" refers to a direction parallel to a width direction of the refrigerator 100.

FIG. 1 is a schematic structure view of one direction of a refrigerator 100 according to one embodiment of the present invention. FIG. 2 is a schematic structure view of another direction of a refrigerator 100 according to one embodiment of the present invention.

As shown in FIG. 1, the refrigerator 100 may generally include a cabinet which includes a housing and a storage liner arranged inside the housing. A space between the housing and the storage liner is filled with a thermal insulation material (forming a foamed layer). At least one storage compartment is defined in the storage liner. The storage liner may generally include a freezing liner, a refrigerating liner and a variable temperature liner. The storage compartment may include a refrigerating chamber 11 defined by the refrigerating liner, a variable temperature chamber 121 defined by the variable temperature liner, and a freezing chamber 131 defined by the freezing liner. A front side of the storage liner is also provided with a door body for opening or closing the storage compartment. For example, a front side of the refrigerating liner is provided with a refrigerating chamber door body 12, a front side of the variable temperature liner is provided with a variable temperature chamber door body 122, and a front side of the freezing liner is provided with a freezing chamber door body 132.

A plurality of storage containers 1311 distributed vertically are arranged in the freezing chamber 131. As shown in FIG. 1, three storage containers 1311 are distributed vertically.

As will be recognized by those skilled in the art, the refrigerator 100 of the present embodiment may further include an evaporator 150, an air blower 102, a compressor 104, a condenser 105 and a throttling element (not shown). The evaporator 150 is located in a cooling chamber 133 and is connected to the compressor 104, the condenser 105 and the throttling element via a refrigerant pipeline to form a refrigeration cycle loop. The evaporator reduces the temperature to cool air flowing therethrough to form a cooled airflow when the compressor 104 is started. The air blower 102 may be a centrifugal fan, a cross-flow fan, or an axial-flow fan.

In particular, in the present embodiment, the air blower 102 is located on a transverse side of the evaporator 150, located downstream of the evaporator 150 in an airflow path, and configured to cause at least part of the cooled airflow to flow into the at least one storage compartment.

In the refrigerator 100 of the present embodiment, the air blower 102 is located on the transverse side of the evaporator 150, and does not occupy a space behind or in front of the evaporator 150, which reduces a space occupied by the cooling chamber 133 in a front-rear direction, and ensures the thickness of a foamed material between the rear of the cooling chamber 133 and a housing of the cabinet.

In some embodiments, as shown in FIG. 1, the cooling chamber 133 may be defined by a lowermost space in the freezing liner. That is, the aforementioned cooling chamber 133 is defined at a lower part in the freezing liner, and the freezing chamber 131 defined by the freezing liner is located above the cooling chamber 133.

The air blower 102 is arranged in the cooling chamber 133, located on a first transverse side of the evaporator 150, and configured to cause at least part of the cooled airflow to flow into the freezing chamber 131 through a freezing chamber air supply duct 160.

In the conventional refrigerator 100, the cooling chamber 133 is generally located in a rear space of the cabinet, the freezing chamber 131 is generally located on the lowermost side of the cabinet, a compressor chamber is located on the rear lower side of the freezing chamber 131, and the freezing chamber 131 is inevitably constructed as a special-shaped space giving way to the compressor chamber, thereby reducing the storage volume of the freezing chamber 131, and also causing the following problems. On one hand, the freezing chamber 131 is located at a lower position, and a user needs to bend or squat greatly to take and place articles in the freezing chamber 131, so it is inconvenient for the user, particularly for the elderly. On the other hand, since the depth of the freezing chamber 131 is reduced, in order to ensure the storage volume of the freezing chamber 131, the space in a height direction of the freezing chamber 131 needs to be increased, and a user needs to stack articles in the height direction when storing the articles into the freezing chamber 131; thus, it is inconvenient for the user to find the articles, and the articles at the bottom of the freezing chamber 131 are easily shielded, so that the user cannot easily find and forget the articles, resulting in deterioration and wasting of the articles Moreover, since the freezing chamber 131 has a special shape and is not a rectangular space, it is inconvenient to place some articles which are large in volume and are not easily divided into the freezing chamber 131.

In the present embodiment, the lower space in the freezing liner defines the cooling chamber 133, so that the cooling chamber 133 occupies the lower space in the cabinet. That is, the cooling chamber 133 is arranged at the bottom. The freezing chamber 131 is located above the cooling chamber 133, so that the freezing chamber 131 is raised, the bending degree of a user when taking and placing articles in the freezing chamber 131 is reduced, and the use experience of the user is improved. Meanwhile, the cabinet may define the compressor chamber on the rear lower side of the cooling chamber 133. That is, the compressor chamber is located on the rear lower side of the cooling chamber 133, the freezing chamber 131 does not need to give way to the compressor chamber any more, and the storage volume of the freezing chamber 131 is ensured, so that the freezing chamber 131 is a rectangular space. Thus, articles can be stored in a tiled expansion storage manner instead of a stacked storage manner and can be conveniently searched by a user, so that the time and energy of the user are saved. Meanwhile, articles which are large in volume and are not easily divided can be conveniently placed, and the problem that a large article cannot be placed in the freezing chamber 131 is solved.

With regard to the embodiment in which the cooling chamber 133 is located in the lower space in the cabinet and the compressor chamber is located on the rear lower side of the cooling chamber 133, the thickness of the foamed material between the rear lower side of the cooling chamber 133 and the compressor chamber directly affects the refrigeration performance of the refrigerator. In the patent previously filed by the applicants, the air blower 102 is arranged behind the evaporator 150, which increases the size of the cooling chamber 133 in the front-rear direction. The space between the rear of the cooling chamber 133 and the compressor chamber is small, so that the thickness of the foamed material between the cooling chamber 133 and the compressor chamber is reduced, and certain influences are exerted on the refrigeration performance, energy consumption and the like of the refrigerator 100.

The air blower 102 is located on a first transverse side of the evaporator 150. Accordingly, the freezing chamber air supply duct 160 is located inside a first transverse side wall of the freezing liner and provided with at least one first air supply outlet communicated with the freezing chamber 131. The air blower 102 is configured to cause at least part of the cooled airflow to flow to the freezing chamber 131 through the freezing chamber air supply duct 160.

Figure 3:
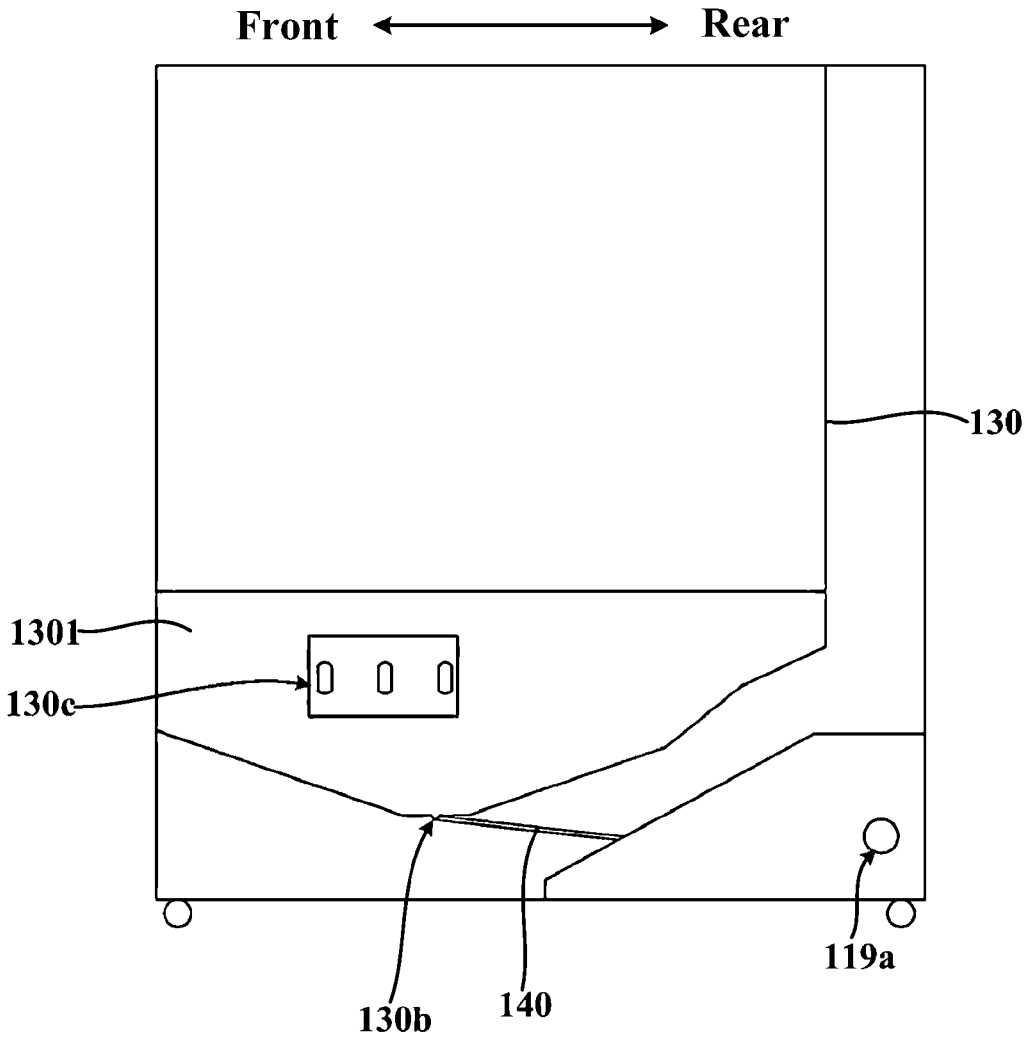
FIG. 3 is a first partial schematic view of a refrigerator according to one embodiment of the present invention.

FIG. 3 is a first partial schematic view of a refrigerator 100 according to one embodiment of the present invention. FIG. 4 is a schematic structure view of a casing 134 of a refrigerator 100 according to one embodiment of the present invention.

The refrigerator 100 further includes a casing 134 arranged in the freezing liner 130. The casing 134 covers the evaporator 150. A first transverse side of the casing 134 may be opened. The air blower 102 is located on the first transverse side of the evaporator 150. The aforementioned cooling chamber 133 is defined by the casing 134, a bottom wall of the freezing liner 130, and a first transverse side wall of the freezing liner 130 by means of the connection of the opened part of the first transverse side of the casing 134 and the freezing chamber air supply duct 160.

The evaporator 150 as a whole may be transversely arranged in the cooling chamber in the shape of a flat cube. That is, a length-width surface of the evaporator 150 is parallel to a horizontal plane, a thickness surface of the evaporator is perpendicular to the horizontal plane, and the thickness size of the evaporator 150 is significantly smaller than the length size thereof. By arranging the evaporator 150 transversely in the cooling chamber 133, the evaporator 150 is prevented from occupying more space, and the storage volume of the freezing chamber 131 above the cooling chamber 133 is ensured.

A freezing chamber return air inlet 134*a* is formed on a second transverse side wall of the cooling chamber 133 (i.e. a second transverse side wall 1341 of the casing 134), so that a return airflow of the freezing chamber 131 enters the cooling chamber 133 through a freezing chamber return air passage 170 via the freezing chamber return air inlet 134*a* under the driving of the air blower 102 and is cooled by the evaporator 150. The freezing chamber return air passage 170 is defined by a gap between a second transverse side wall of the freezing liner 130 and the storage containers 1311.

In the patent previously filed by the applicants, a front return air inlet communicated with the freezing chamber 131 is formed in a front side of the cooling chamber 133 (i.e., a front wall of the casing 134). External impurities are easily introduced into the cooling chamber 133 through the front return air inlet, and melted frost may flow out of the front return air inlet during defrosting of the evaporator 150. In addition, when the freezing chamber door body 132 is opened, a large amount of warm moisture may enter the cooling chamber 133 from the front return air inlet, increasing the frosting amount. However, in the present embodiment, by arranging the air blower 102 on the transverse side (e.g., first transverse side) of the evaporator 150 and forming the freezing chamber return air inlet 134*a* communicated with the freezing chamber 131 on the second transverse side wall of the cooling chamber 133, the above problems can be effectively solved, the appearance of the front side of the cooling chamber 133 can be made simpler, and the visual feeling when a user opens the freezing chamber door body 132 can be better.

The variable temperature liner of the refrigerator 100 is located above the freezing liner 130. A variable temperature chamber air supply duct is arranged outside a first transverse side wall of the variable temperature liner, located in a foamed layer, and provided with at least one second air supply outlet communicated with the variable temperature chamber 121. A top end of the freezing chamber air supply duct 160 is provided with a variable temperature damper 103, and the variable temperature damper 103 may be controllably opened or closed to communicate the variable temperature chamber air supply duct with the freezing chamber air supply duct 160.

As shown in FIG. 3, a variable temperature chamber return air inlet 130*c* is formed in a region, corresponding to the evaporator 150, of the second transverse side wall 1301 of the freezing liner 130, and a variable temperature chamber return air duct is arranged outside a second transverse side wall of the variable temperature liner and extends downwards to be communicated with the variable temperature chamber return air inlet 130*c*.

Obviously, the second transverse side wall of the cooling chamber 133 (i.e., the second transverse side wall 1341 of the casing 134) and the second transverse side wall 1301 of the freezing liner 130 are located on the same transverse side, and accordingly, the variable temperature chamber return air inlet 130*c* and the freezing chamber return air inlet 134*a* are located on the same transverse side. A return airflow entering through the variable temperature chamber return air inlet 130*c* enters the cooling chamber 133 through the freezing chamber return air inlet 134*a* and is cooled by the evaporator 150. Specifically, under the driving of the air blower 102, the return airflow of the variable temperature chamber 121 flows to the variable temperature chamber return air inlet 130*c* through the variable temperature chamber return air duct, enters the cooling chamber 133 through the variable temperature chamber return air inlet 130*c* and the freezing chamber return air inlet 134*a* and is cooled by the evaporator 150.

The freezing chamber 131 and the variable temperature chamber 121 above are both air-cooled, and the refrigerating chamber 11 may be directly cooled. A refrigerating evaporator (not shown) is disposed in the refrigerating liner, and directly cools the refrigerating chamber 11.

A section of the bottom wall of the freezing liner 130 directly below the evaporator 150 is denoted as a water receiving section, which is generally funnel-shaped and configured to receive the melted frost of the evaporator 150. The aforementioned water drainage outlet 130*b* is formed at the lowest point of the water receiving section. The water drainage outlet 130*b* is connected with a water drainage pipe 140. The melted frost is conveyed to an evaporation dish (not numbered) located in the compressor chamber through the water drainage pipe 140. The evaporation dish is generally located below the condenser 105. The melted frost in the evaporation dish absorbs heat from the condenser 105 to evaporate.

FIG. 5 is a partial exploded view of a refrigerator 100 according to one embodiment of the present invention. FIG. 6 is a schematic view of a housing of a refrigerator 100 according to one embodiment of the present invention. FIG. 7 is an enlarged view of a region A in FIG. 6.

Generally, as shown in FIG. 5, the compressor 104, the condenser 105 and the heat dissipation fan 106 are disposed in the compressor chamber defined in the cabinet. The heat dissipation fan 106 is configured to cause an airflow entering the compressor chamber to pass sequentially through the condenser 105 and the compressor 104 and then to flow out of the compressor chamber. The heat dissipation fan 106 may be an axial-flow fan. In the present embodiment, the compressor 104, the heat dissipation fan 106 and the condenser 105 are transversely and sequentially spaced apart in the compressor chamber.

In some embodiments, at least one rear air outlet 1162*a* is formed in a section 1162 of a rear wall of the compressor chamber corresponding to the compressor 104.

In fact, prior to the present invention, a common design idea for those skilled in the art is to provide a rear air inlet facing the condenser 105 and the rear air outlet 1162*a* facing the compressor 104 in the rear wall of the compressor chamber, and to complete the cycle of a heat dissipation airflow at the rear of the compressor chamber; or to form ventilation holes in the front and rear walls of the compressor chamber respectively to form a heat dissipation cycle air passage in the front-rear direction. For the problem of improving the heat dissipation effect of the compressor chamber, those skilled in the art generally increase the number of rear air inlets and rear air outlets 1162*a* in the rear wall of the compressor chamber to increase the ventilation area, or increase the heat exchange area of the condenser 105, for example, using a U-shaped condenser with a larger heat exchange area.

The applicants of the present invention creatively realized that the heat exchange area of the condenser 105 and the ventilation area of the compressor chamber are not as larger as better, and in a conventional design scheme for increasing the heat exchange area of the condenser 105 and the ventilation area of the compressor chamber, the problem of non-uniform heat dissipation of the condenser 105 is caused, and adverse effects are generated on a refrigerating system of the refrigerator 100. To this end, the applicants of the present invention jumped out of the conventional design idea and creatively proposed a new scheme different from the conventional design. A bottom wall of the cabinet is defined with a bottom air inlet 110*a* adjacent to the condenser 105 and a bottom air outlet 110*b* adjacent to the compressor 104 which are transversely arranged. The cycle of the heat dissipation airflow is completed at the bottom of the refrigerator 100, the space between the refrigerator 100 and a supporting surface is fully utilized, the distance between the rear wall of the refrigerator 100 and a cupboard does not need to be increased, the space occupied by the refrigerator 100 is reduced while heat from the compressor chamber can be well dissipated, the problem that the heat dissipation of the compressor chamber and the space occupation of a built-in refrigerator 100 cannot be balanced is fundamentally solved, and the present invention is of particularly important significance.

The heat dissipation fan 106 is configured to cause ambient air around the bottom air inlet 110*a* to enter the compressor chamber from the bottom air inlet 110*a*, to sequentially pass through the condenser 105 and the compressor 104, and then to flow from the bottom air outlet 110*b* to an external environment so as to dissipate heat from the compressor 104 and the condenser 105.

In a vapor compression refrigeration cycle, the surface temperature of the condenser 105 is generally lower than that of the compressor 104, so the external air is made to cool the condenser 105 first and then cool the compressor 104 in the process above.

Furthermore particularly, in a preferred embodiment of the present invention, a plate section 1161 of a back plate 116 (the rear wall of the compressor chamber) facing the condenser 105 is a continuous plate surface. That is, the plate section 1161 of the back plate 116 facing the condenser 105 has no heat dissipation holes.

The applicants of the present invention creatively realized that even if the heat exchange area of the condenser 105 is not increased, a better heat dissipation airflow path can be formed by reducing the ventilation area of the compressor chamber abnormally, and a better heat dissipation effect can still be achieved.

In a preferred scheme of the present invention, the applicants broke through the conventional design idea. The plate section 1161 of the rear wall (back plate 116) of the compressor chamber corresponding to the condenser 105 is designed to be the continuous plate surface, and the heat dissipation airflow entering the compressor chamber is sealed at the condenser 105, so that the ambient air entering from the bottom air inlet 110*a* is more concentrated at the condenser 105, thereby ensuring the heat exchange uniformity of each condensation section of the condenser 105, favorably forming a better heat dissipation airflow path, and achieving a better heat dissipation effect as well.

Moreover, the plate section 1161 of the back plate 116 facing the condenser 105 is the continuous plate surface and is not provided with the air inlet, so that the problems that in conventional design, air exhaust and air feeding are both concentrated at the rear part of the compressor chamber, which causes that the hot air blown from the compressor chamber enters the compressor chamber again without being cooled by the ambient air in time, causing adverse effects on heat exchange of the condenser 105 are avoided, and thus the heat exchange efficiency of the condenser 105 is ensured.

In some embodiments, both transverse side walls of the compressor chamber are separately provided with a side ventilation hole 119*a*. The side ventilation hole 119*a* may be covered with a ventilation cover plate 108. Small grilled ventilation holes are formed in the ventilation cover plate 108. The housing of the refrigerator 100 includes two cabinet side plates 111 in a transverse direction. The two cabinet side plates 111 extend vertically to form two side walls of the refrigerator 100. The two cabinet side plates 111 are respectively provided with a side opening 111*a* communicated with the corresponding side ventilation hole 119*a* so that the heat dissipation airflow flows to the outside of the refrigerator 100. Therefore, the heat dissipation path is further increased, and the heat dissipation effect of the compressor chamber is ensured.

Furthermore particularly, the condenser 105 includes a first straight section 1051 extending transversely, a second straight section 1052 extending forwards and rearwards, and a transitional curved section (not numbered) connecting the first straight section 1051 and the second straight section 1052, thereby forming an L-shaped condenser 105 having an appropriate heat exchange area. The plate section 1161 of the rear wall (back plate 116) of the aforementioned compressor chamber corresponding to the condenser 105 is the plate section 1161 of the back plate 116 facing the first straight section 1051.

The ambient airflow entering from the side ventilation hole 119*a* directly exchanges heat with the second straight section 1052, and the ambient air entering from the bottom air inlet 110*a* directly exchanges heat with the first straight section 1051, thereby further concentrating the ambient air entering the compressor chamber more at the condenser 105 to ensure the uniformity of the overall heat dissipation of the condenser 105.

Furthermore particularly, the housing of the cabinet further includes a bottom plate, a supporting plate 112, two side plates 119 and a vertically extending back plate 116. The supporting plate 112 forms a bottom wall of the compressor chamber and is configured to support the compressor 104, the heat dissipation fan 106 and the condenser 105. The two side plates 119 form two transverse side walls of the compressor chamber respectively. The vertically extending back plate 116 forms the rear wall of the compressor chamber.

Furthermore particularly, the bottom plate includes a bottom horizontal section 113 located on a bottom front side and a bent section bending and extending upwards and rearwards from a rear end of the bottom horizontal section 113. The bent section extends to the upper side of the supporting plate 112. The compressor 104, the heat dissipation fan 106 and the condenser 105 are transversely and sequentially spaced apart on the supporting plate 112 and are located in a space defined by the supporting plate 112, the two side plates 119, the back plate and the bent section.

The supporting plate 112 and the bottom horizontal section 113 together form the bottom wall of the cabinet, and the supporting plate 112 is spaced apart from the bottom horizontal section 113 to form a bottom opening communicated with an external space using a space between a front end of the supporting plate 112 and a rear end of the bottom horizontal section 113. The bent section has an inclined section 114 located above the bottom air inlet 110*a* and the bottom air outlet 110*b*.

Specifically, the bent section may include a vertical section 1131, the inclined section 114 and a top horizontal section 115. The vertical section 1131 extends upwards from the rear end of the bottom horizontal section 113. The inclined section 114 extends upwards and rearwards from an upper end of the vertical section 1131 to the upper side of the supporting plate 112. The top horizontal section 115 extends rearwards from a rear end of the inclined section 114 to the back plate, so as to cover the upper sides of the compressor 104, the heat dissipation fan 106 and the condenser 105.

Furthermore particularly, the refrigerator 100 further includes a divider 117. The divider 117 is arranged behind the bent section, has a front part connected to the rear end of the bottom horizontal section 113 and a rear part connected to the front end of the supporting plate 112, and is configured to divide the bottom opening into the bottom air inlet 110*a* and the bottom air outlet 110*b* transversely arranged.

It can be known from the foregoing that the bottom air inlet 110*a* and the bottom air outlet 110*b* of the present embodiment are defined by the divider 117, the supporting plate 112 and the bottom horizontal section 113, so that the groove-shaped bottom air inlet 110*a* and the groove-shaped bottom air outlet 110*b* with large opening sizes are formed, the air feeding area and the air exhaust area are increased, the air feeding resistance is reduced, making the circulation of airflow smoother, the manufacturing process is simpler, and the integral stability of the compressor chamber is stronger.

In particular, the applicants of the present invention creatively realized that a slope structure of the inclined section 114 is capable of guiding and rectifying feeding airflow, so that the airflow entering from the bottom air inlet 110*a* flows more concentratedly to the condenser 105, avoiding that the airflow is too dispersed to pass more through the condenser 105, thereby further ensuring the heat dissipation effect of the condenser 105. Meanwhile, the slope of the inclined section 114 guides exhaust airflow from the bottom air outlet 110*b* to the front side of the bottom air outlet, so that the exhaust airflow flows out of the compressor chamber more smoothly, and thus the smoothness of airflow circulation is further improved.

Furthermore particularly, in a preferred embodiment, the inclined section 114 has an included angle of less than 45° with the horizontal plane, and in such embodiment, the inclined section 114 is better in airflow guiding and rectifying effect.

Moreover, it is unexpected that the applicants of the present application creatively realized that the slope of the inclined section 114 provides a better dampening effect on airflow noise, and in prototype tests, noise of the compressor chamber with the aforementioned specially designed inclined section 114 can be reduced by 0.65 decibel or above.

In addition, in the conventional refrigerator 100, the bottom of the cabinet generally has a bearing plate of a substantially flat plate type structure. The compressor 104 is arranged inside the bearing plate, and vibration generated during operation of the compressor 104 has a great influence on the bottom of the cabinet. However, in the present embodiment, as described above, the bottom of the cabinet is constructed into a three-dimensional structure by the bottom plate and the supporting plate 112 of a special structure, an independent three-dimensional space is provided for the arrangement of the compressor 104, the supporting plate 112 is used for supporting the compressor 104, and the influence of vibration of the compressor 104 on other components at the bottom of the cabinet is reduced. In addition, the cabinet is designed into the above smart special structure, so that the bottom of the refrigerator 100 is compact in structure and reasonable in layout, the overall volume of the refrigerator 100 is reduced, the space at the bottom of the refrigerator 100 is fully utilized, and the heat dissipation efficiency of the compressor 104 and the condenser 105 is ensured.

Furthermore particularly, a wind blocking piece 1056 is arranged at the upper end of the condenser 105. The wind blocking piece 1056 may be wind blocking sponge for filling a space between the upper end of the condenser 105 and the bent section. That is, the wind blocking piece 1056 covers the upper ends of the first straight section 1051, the second straight section 1052 and the transitional curved section, and the upper end of the wind blocking piece 1056 should abut against the bent section to seal the upper end of the condenser 105, so that the situation that part of the air entering the compressor chamber passes through the space between the upper end of the condenser 105 and the bent section and does not pass through the condenser 105 is avoided, thus the air entering the compressor chamber is subjected to heat exchange through the condenser 105 as much as possible, and the heat dissipation effect of the condenser 105 is further improved.

Furthermore particularly, the refrigerator 100 further includes a wind blocking strip 107 extending forwards and rearwards. The wind blocking strip 107 is located between the bottom air inlet 110*a* and the bottom air outlet 110*b*, extends from a lower surface of the bottom horizontal section 113 to a lower surface of the supporting plate 112, and is connected to a lower end of the divider 117, so as to completely separate the bottom air inlet 110*a* and the bottom air outlet 110*b* using the wind blocking strip 107 and divider 117, so that when the refrigerator 100 is placed on a supporting surface, a space between the bottom wall of the cabinet and the supporting surface is transversely divided to allow external air to enter the compressor chamber through the bottom air inlet 110*a* on a transverse side of the wind blocking strip 107 under the action of the heat dissipation fan, to sequentially flow through the condenser 105 and the compressor 104, and to finally flow out of the bottom air outlet 110*b* on the other transverse side of the wind blocking strip 107. Thus, the bottom air inlet 110*a* and the bottom air outlet 110*b* are completely separated, and cross flowing of the external air entering the condenser 105 and the heat dissipation air discharged from the compressor 104 is avoided, thereby further ensuring the heat dissipation efficiency.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from contents disclosed in the present invention. Therefore, the scope of the present invention should be understood and recognized as covering all these other variations or modifications.

The invention claimed is:

1. A refrigerator, comprising:

a cabinet, in which are defined a cooling chamber and at least one storage compartment;

an evaporator, arranged in the cooling chamber and configured to cool an airflow entering the cooling chamber to form a cooled airflow;

an air blower, located on a transverse side of the evaporator, located downstream of the evaporator in an airflow path, and configured to cause at least part of the cooled airflow to flow into the at least one storage compartment;

a compressor chamber further defined in the cabinet and located behind and below the cooling chamber, a top end of the compressor chamber being higher than a bottom end of the cooling chamber;

a compressor;

a heat dissipation fan; and a condenser, wherein:

the compressor, the heat dissipation fan, and the condenser are transversely and sequentially arranged in the compressor chamber, a bottom air inlet adjacent to the condenser and a bottom air outlet adjacent to the compressor, which are transversely arranged, are defined on a bottom wall of the cabinet, and the heat dissipation fan is configured to suck ambient air from the bottom air inlet and cause the air to pass through the condenser and the compressor and then to flow into an ambient environment from the bottom air outlet.

2. The refrigerator according to claim 1, wherein the cabinet comprises:

a freezing liner, in which the cooling chamber is defined at a lower part, the at least one storage compartment comprising a freezing chamber defined by the freezing liner and located above the cooling chamber; and a freezing chamber air supply duct, located inside a first transverse side wall of the freezing liner and provided with at least one first air supply outlet communicated with the freezing chamber, the air blower being configured to cause at least part of the cooled airflow to flow into the freezing chamber through the freezing chamber air supply duct, wherein the air blower is arranged in the cooling chamber, located on a position at the transverse side of the evaporator and between the evaporator and the freezing chamber air supply duct, and configured to cause at least part of the cooled airflow to flow into the freezing chamber through the freezing chamber air supply duct.

3. The refrigerator according to claim 2, wherein a freezing chamber return air inlet is formed on a transverse side wall of the cooling chamber opposite to the first transverse side wall of the freezing liner, so that a return airflow of the freezing chamber enters the cooling chamber through the freezing chamber return air inlet under the driving of the air blower and is cooled by the evaporator.

4. The refrigerator according to claim 2, wherein the cabinet further comprises:

a variable temperature liner, located above the freezing liner, the at least one storage compartment comprising a variable temperature chamber defined by the variable temperature liner, and a variable temperature chamber return air inlet being formed in a region, corresponding to the evaporator, of a second transverse side wall of the freezing liner;

a variable temperature chamber air supply duct, arranged outside a first transverse side wall of the variable temperature liner, controllably communicated with the freezing chamber air supply duct through a variable temperature damper, and provided with at least one second air supply outlet communicated with the variable temperature chamber; and a variable temperature chamber return air duct, arranged outside a second transverse side wall of the variable temperature liner, and extending downwards to be communicated with the variable temperature chamber return air inlet, so that a return airflow of the variable temperature chamber enters the cooling chamber through the variable temperature chamber return air duct and the variable temperature chamber return air inlet under the driving of the air blower and is cooled by the evaporator.

5. The refrigerator according to claim 1, wherein the evaporator is transversely arranged in the cooling chamber.

6. The refrigerator according to claim 1, wherein the cabinet further comprises:

a bottom plate, comprising a bottom horizontal section located on a bottom front side and a bent section bending and extending upwards and rearwards from a rear end of the bottom horizontal section, the bent section comprising an inclined section located above the bottom air inlet and the bottom air outlet;

a supporting plate, located behind the bottom horizontal section, the bent section extending to an upper side of the supporting plate, wherein the supporting plate together with the bottom horizontal section forms the bottom wall of the cabinet and is spaced apart from the bottom horizontal section, so that a bottom opening is defined by the rear end of the bottom horizontal section and a front end of the supporting plate;

two side plates, extending upwards to both transverse sides of the bent section from both transverse sides of the supporting plate respectively to form two transverse side walls of the compressor chamber; and a vertically extending back plate, extending upwards from a rear end of the supporting plate to a rear end of the bent section to form a rear wall of the compressor chamber, wherein:

the compressor, the heat dissipation fan and the condenser are transversely and sequentially spaced apart on the supporting plate and are located in a space defined by the supporting plate, the two side plates, the back plate and the bent section; and the cabinet further comprises a divider, which is arranged behind the bent section, has a front part connected to the rear end of the bottom horizontal section and a rear part connected to the front end of the supporting plate, and is configured to divide the bottom opening into the bottom air inlet and the bottom air outlet transversely arranged.

7. The refrigerator according to claim 6, wherein the cabinet further comprises:

a wind blocking strip extending forwards and rearwards, located between the bottom air inlet and the bottom air outlet, extending from a lower surface of the bottom horizontal section to a lower surface of the supporting plate, and connected to a lower end of the divider, so as to completely separate the bottom air inlet and the bottom air outlet using the wind blocking strip and the divider, so that when the refrigerator is placed on a supporting surface, a space between the bottom wall of the cabinet and the supporting surface is transversely divided to allow external air to enter the compressor chamber through the bottom air inlet on a transverse side of the wind blocking strip under the action of the heat dissipation fan, to sequentially flow through the condenser and the compressor, and to finally flow out of the bottom air outlet on the other transverse side of the wind blocking strip.

8. The refrigerator according to claim 6, wherein a plate section of the back plate facing the condenser is a continuous plate surface.

* * * * *